US006439632B1

(12) United States Patent
Webber

(10) Patent No.: US 6,439,632 B1
(45) Date of Patent: Aug. 27, 2002

(54) PALLET LIFTING HOOK

(76) Inventor: Jeff Webber, 1100 W. New Hope Rd., Boonville, IN (US) 47601

( * ) Notice: Subject to any disclaimer, the term of this patent is extended or adjusted under 35 U.S.C. 154(b) by 0 days.

(21) Appl. No.: 09/752,474

(22) Filed: Jan. 2, 2001

(51) Int. Cl.[7] ..... B66C 1/54
(52) U.S. Cl. ..... 294/97
(58) Field of Search ..... 294/86.24, 86.25, 294/89, 93, 95, 97, 115, 116

(56) References Cited

U.S. PATENT DOCUMENTS

| | | | | | |
|---|---|---|---|---|---|
| 735,616 | A | * | 8/1903 | Stitt | 294/97 |
| 1,282,479 | A | * | 10/1918 | Smith | 294/97 X |
| 1,735,713 | A | * | 11/1929 | Alltop | 294/97 |
| 2,305,320 | A | * | 12/1942 | Rea | 294/97 |
| 2,789,859 | A | * | 4/1957 | Woellner | 294/97 X |
| 2,809,070 | A | * | 10/1957 | Nelson | 294/97 |
| 3,057,651 | A | * | 10/1962 | Lloyd | 294/97 X |
| 3,583,753 | A | | 6/1971 | McCrery | |
| 4,017,115 | A | | 4/1977 | Holt et al. | |
| 4,253,624 | A | | 3/1981 | Colbert | |
| 4,316,535 | A | | 2/1982 | Brems et al. | |
| 4,422,684 | A | * | 12/1983 | Zitzman | 294/97 |
| 4,475,758 | A | | 10/1984 | Paulsson | |
| 4,770,394 | A | | 9/1988 | Yang | |
| 4,784,398 | A | | 11/1988 | Lund | |
| 5,288,265 | A | | 2/1994 | Beason et al. | |
| 5,765,891 | A | | 6/1998 | Fredriksson | |
| 5,873,776 | A | | 2/1999 | Klepac | |

FOREIGN PATENT DOCUMENTS

| | | | | |
|---|---|---|---|---|
| FR | 2592642 | * | 7/1987 | 294/97 |

* cited by examiner

*Primary Examiner*—Johnny D. Cherry
(74) *Attorney, Agent, or Firm*—John D. Gugliotta

(57) ABSTRACT

A pallet hook is provided to aid in the lifting of tube frame products made for the wire and tubing industry. The tool or device has four movable flippers that extend outward to grab the tube based frame of the item to be lifted. A movable linkage connected to the handle provides the means to lift the flippers out of the way for extraction. These flippers, when impinging against the stop block, provide the locking force necessary to lift. A lifting eye located on the end of the handle provides a connection point for a crane or other type of lifting aid. After the item has been moved and the crane hook disconnected, the user simply lifts the handle of the invention to retract the internal flippers and then withdraws the invention.

4 Claims, 3 Drawing Sheets

PALLET LIFTING HOOK

RELATED APPLICATIONS

The present invention was first described in Disclosure Document Number 468,913 filed on Feb. 10, 2000. There are no previously filed, nor currently any co-pending applications, anywhere in the world.

BACKGROUND OF THE INVENTION

1. Field of the Invention

The present invention relates generally to grappling type handling implements and, more particularly, to such a device having hinged flippers, in combination with the activation linkage as designed for their specific grasping task.

2. Description of the Related Art

As anyone who performs a lot of physical work will attest, nothing beats having the proper tool for a job. The proper tool can save time, save money, produce a higher quality job, reduce damage to equipment, and provide for the increased safety of the worker. A prime example of this philosophy is evident in manufacturing facilities, shipping and receiving docks across the country. Here, large, bulky and heavy objects are made and shipped everywhere. Due to the configuration of many of these products, special shipping containers and/or universal access holes are provided for uniformity. Such is the case for tube frame products made for the wire and tubing industry. However, these holes do not lend themselves to be lifted by a crane or other overhead device.

A search of the prior art did not disclose any patents that read directly on the claims of the instant invention; however, the following references were considered related.

U.S. Pat. No. 5,873,776 issued in the name of Klepac discloses an expandable gambrel apparatus for an overhead hoist.

U.S. Pat. No. 5,765,891 issued in the name of Fredriksson describes a lifting hook with anchoring and bridge members.

U.S. Pat. No. 5,288,265 issued in the name of Beason et aL discloses a hinged and foldable gambrel support attachment for a hoist.

U.S. Pat. No. 4,784,398 issued in the name of Lund describes a hoist lift adaptation for insertion into a cone.

U.S. Pat. No. 4,770,394 issued in the name of Yang discloses a pulley hoist and attached lifting hook.

U.S. Pat. No. 4,475,758 issued in the name of Paulsson describes a lifting hook for overhead hoists with a suspended lifting member.

U.S. Pat. No. 4,017,115 issued in the name of Holt et al. discloses an attachment for an overhead hoist for lifting concrete slabs.

U.S. Pat. No. 3,583,753 issued in the name of McCrory describes a center pallet hook with toggle.

U.S. Pat. No. 4,253,624 issued in the name of Colbert describes a welding wire dispenser.

And, U.S. Pat. No. 4,316,535 issued in the name of Brems et al. describes a workpiece storage system.

Consequently, there exists a need for a means by which tube frame products made for the wire and tubing industry can be lifted in a quick, easy and effective manner utilizing the square hole that is common on such products.

SUMMARY OF THE INVENTION

It is therefore an object of the present invention to provide an improved pallet lifting hook.

It is a feature of the present invention to provide an improved pallet lifting hook specifically adapted and designed to fit the common universal square hole common on tube frame pallets made for the wire and tubing industry.

Briefly described according to one embodiment of the present invention, a pallet hook is provided to aid in the lifting of tube frame products made for the wire and tubing industry. The tool or device has four movable flippers that extend outward to grab the tube based frame of the item to be lifted. A movable linkage connected to the handle provides the means to lift the flippers out of the way for extraction. These flippers, when impinging against the stop block, provide the locking force necessary to lift. A lifting eye located on the end of the handle provides a connection point for a crane or other type of lifting aid. After the item has been moved and the crane hook disconnected, the user simply lifts the handle of the invention to retract the internal flippers and then withdraws the invention.

The use of the present invention allows for the lifting of tube frame products in a quick, easy and effective manner while providing for increased productivity and safety.

An advantage of the present invention is that it provides aid in the lifting of tube frame products made for the wire and tubing industry A further advantage of the present invention is that it is designed to fit the common universal square hole common on such products.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
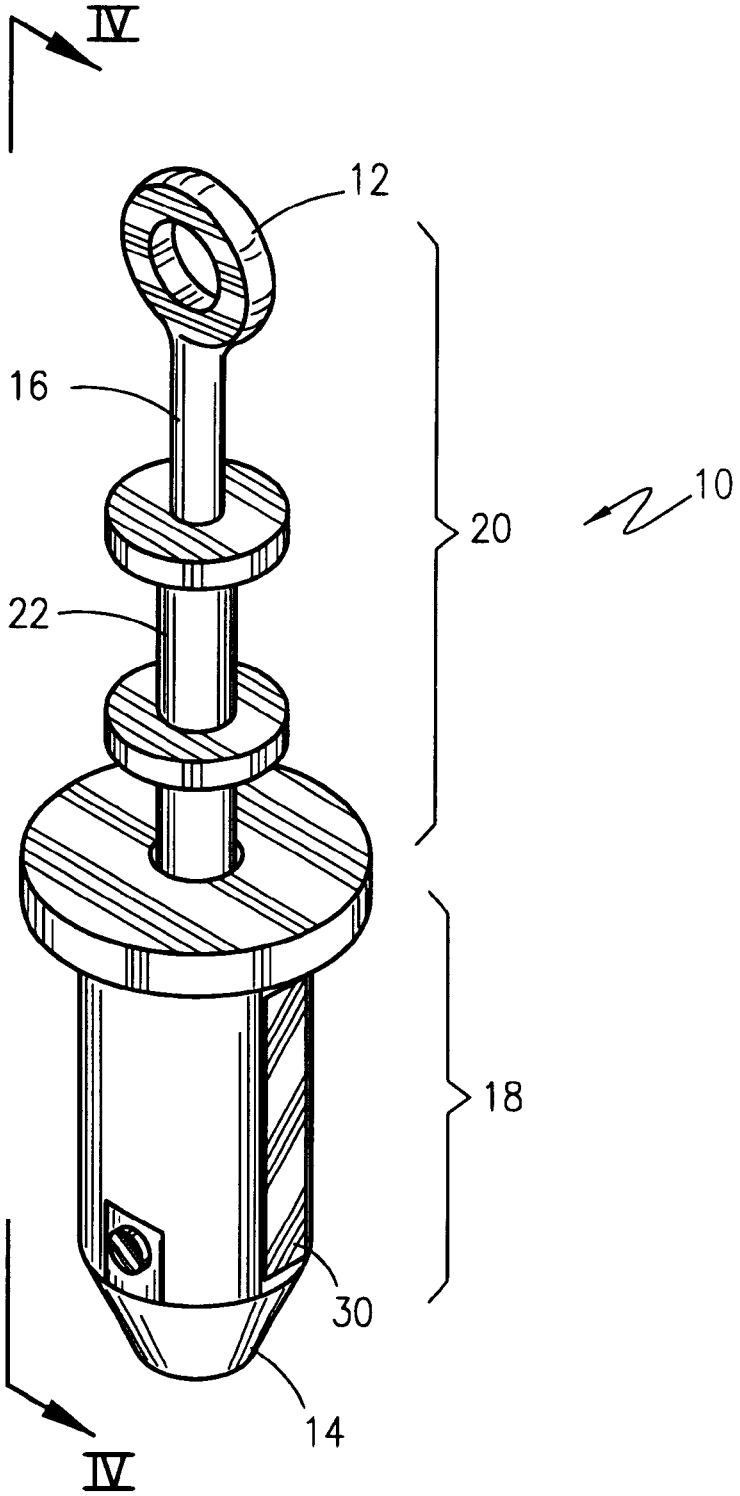
FIG. 1 is a perspective view of a pallet lifting hook according to the preferred embodiment of the present invention.
Figure 2:
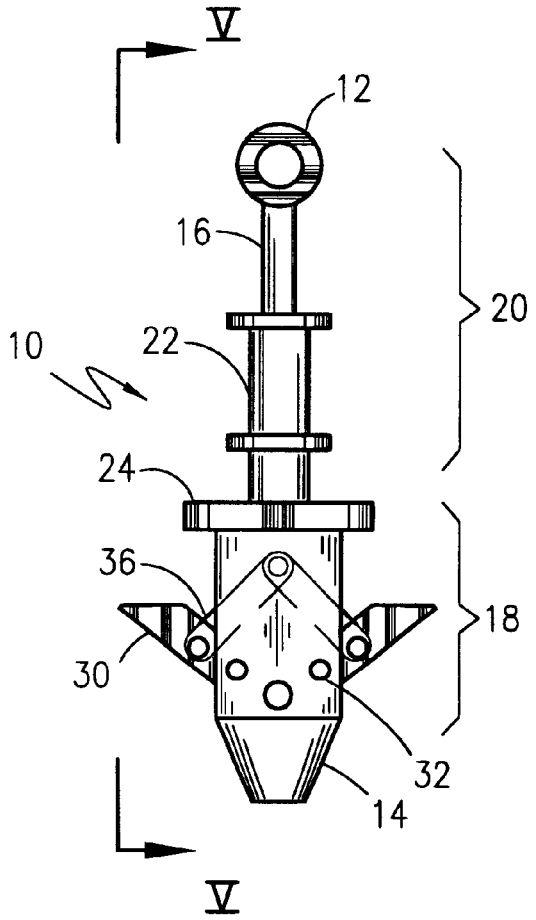
FIG. 2 is a front elevational view thereof shown in a retracted condition.
Figure 3:
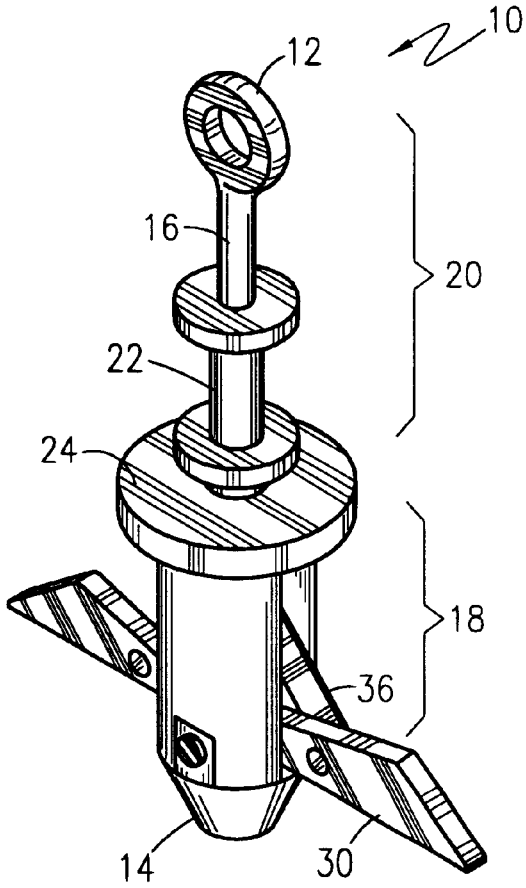
FIG. 3 is a front elevational view thereof shown in an extended condition.
Figure 4:
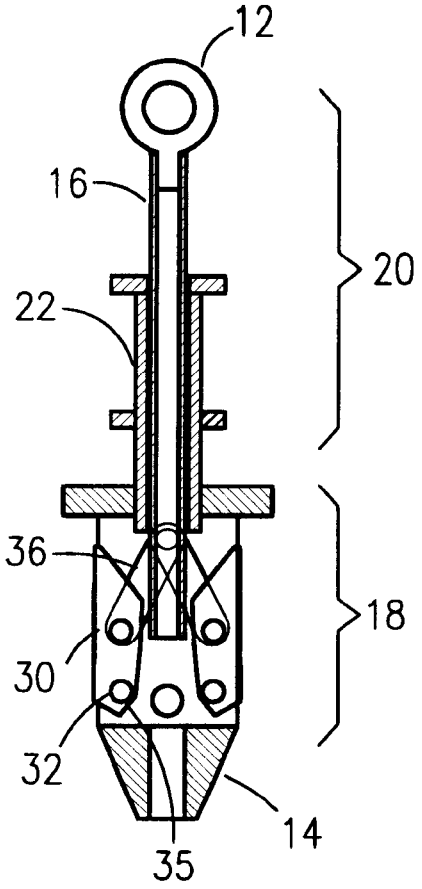
FIG. 4 is a cross sectional elevational view taken along line IV—IV of FIG. 1.
Figure 5:
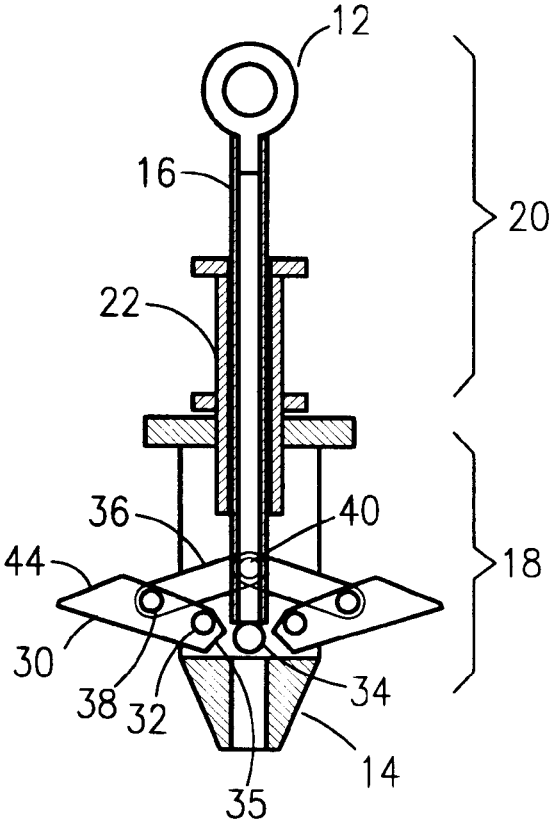
FIG. 5 is a cross sectional elevational view taken along line V—V of FIG. 2.

Referring now to FIG. 1–5, a pallet hook 10 is provided to aid in the lifting of tube frame products made for the wire and tubing industry. An upper eye hook 12 is connected to a cone cap 14, each attached at opposite ends of a linearly elongated vertical support rod 16. The cone cap 14 is tapered to allow for self-guiding when engaging with a receiving hole. A base 18 is affixed above the cone cap 14, and a handle 20 is slidably articulated along the upper end of the vertical support rod 16. The handle 20 includes a guide spindle 22 and extends telescoping into the top of the base 18. The top of the base 18 forms an upper retaining flange 24 extending lateral outward from the vertical support rod 16 to physically impinge against the guide spindle 22 when the guide spindle 22 is fully engaged downward. Within the base are a pair of trapezoidal blades 30, pivotally affixed via a blade pivot hinge 32 to a blade stopping block 34 affixed to the top of the cone cap 14. Each blade 30 is generally trapezoidal, with a braking surface 35 that impinges against the side surface of the blade stopping block 34 when pivoted outward. Further, each blade 30 is pivotally affixed to a linkage 36 via a first linkage pin 38. The linkage 36 is pivotally affixed at its opposite end to the base of the guide spindle 22 by a second linkage pin 40. In this manner, as the guide spindle, 22 is slid downward along the vertical support rod,the linkages drive the blades outward, pivoting about the first linkage pin and flipping outward from the sides of the base. As the stopping surface impinges with the blade stopping block, the opposite ends of each blade, a lifting surface 44, extends outward from the side of the base.

This forms a lifting gambrel that can be extended within a pallet receiving and lifting orifice.

As the guide spindle 22 is slid upward along the vertical support rod, the linkages drive the blades inward, pivoting about the first linkage pin and flipping inward within the sides of the base. The blades flip in, no longer extending past the edge of the base, and allow the base to be removed from a pallet receiving and lifting orifice.

The lifting eye located on the end of the handle provides a connection point for a crane or other type of lifting aid. After the item has been moved and the crane hook disconnected, the user simply lifts the handle of the invention to retract the internal flippers and then withdraws the invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A pallet hook to aid in the lifting of tube frame products made for the wire and tubing industry, said pallet hook comprising:

an upper eye hook connected to a cone cap at opposite ends of a linearly elongated vertical support rod, said cone cap being tapered to allow for self-guiding when engaging with a receiving hole;

a base affixed above said cone cap;

a handle slidably articulated along an upper end of said vertical support rod, wherein said handle includes a guide spindle and extends telescopingly into the top of said base; and a pair of trapezoidal blades within said base and pivotally affixed via a blade pivot hinge to a blade stopping block affixed to the top of said cone cap.

2. The pallet hook of claim 1, wherein the top of said base forms an upper retaining flange extending lateral outward from the vertical support rod to physically impinge against the guide spindle when the guide spindle is fully engaged downward.

3. The hook of claim 1, wherein each said trapezoidal blade further comprimises a braking surface that impinges against a side surface of said blade stopping block when pivoted outward.

4. The pallet hook of claim 3, further comprising:

a linkage having an attachment end opposite a base and wherein each said trapezoidal blade is pivotally affixed to said linkage at its attachment end via a first linkage pin;

a guide spindle, said guide spindle pivotally affixed to the base of said linkage a second linkage pin; and wherein as the guide spindle is slid downward along the vertical support rod the linkages drive the blades outward, pivoting about the first linkage pin and flipping outward from the sides of the base.

* * * * *